US008948424B2

(12) United States Patent
Gerkmann et al.

(10) Patent No.: US 8,948,424 B2
(45) Date of Patent: Feb. 3, 2015

(54) HEARING DEVICE AND METHOD FOR OPERATING A HEARING DEVICE WITH TWO-STAGE TRANSFORMATION

(75) Inventors: Timo Gerkmann, Stockholm (SE); Rainer Martin, Bochum (DE); Henning Puder, Erlangen (DE); Wolfgang Soergel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 850 days.

(21) Appl. No.: 13/180,642

(22) Filed: Jul. 12, 2011

(65) Prior Publication Data

US 2012/0008791 A1 Jan. 12, 2012

(30) Foreign Application Priority Data

Jul. 12, 2010 (DE) ..... 10 2010 026 884

(51) Int. Cl.
*H04R 25/00* (2006.01)

(52) U.S. Cl.
CPC ..... *H04R 25/505* (2013.01); *H04R 2430/03* (2013.01)
USPC ..... 381/312; 381/317; 381/320

(58) Field of Classification Search
USPC ..... 381/23.1, 312, 316, 317, 320, 321, 381/71.11, 94.3, 94.7, 98
See application file for complete search history.

(56) References Cited

U.S. PATENT DOCUMENTS

| | | | | |
|---|---|---|---|---|
| 4,852,175 | A * | 7/1989 | Kates | 381/317 |
| 5,027,410 | A | 6/1991 | Williamson et al. | |
| 8,638,962 | B2 * | 1/2014 | Elmedyb et al. | 381/320 |
| 2008/0159573 | A1 | 7/2008 | Dressler et al. | |
| 2009/0290734 | A1 | 11/2009 | Alfsmann et al. | |
| 2009/0290736 | A1 | 11/2009 | Alfsmann et al. | |
| 2009/0290737 | A1 | 11/2009 | Alfsmann | |

FOREIGN PATENT DOCUMENTS

| | | | |
|---|---|---|---|
| EP | 0362783 | A2 | 4/1990 |
| EP | 1919257 | A2 | 5/2008 |
| EP | 2124334 | A2 | 11/2009 |
| EP | 2124335 | A2 | 11/2009 |
| EP | 2124482 | A2 | 11/2009 |

OTHER PUBLICATIONS

Gülzow et al., "Comparison of a discrete wavelet transformation and a nonuniform polyphase filterbank applied to spectral speech enhancement" Signal Processing 64, 1998 pp. 5-19.

(Continued)

*Primary Examiner* — Huyen D Le
(74) *Attorney, Agent, or Firm* — Laurence A. Greenberg; Werner H. Stemer; Ralph E. Locher

(57) ABSTRACT

A filter bank with a sufficiently high resolution for amplification and noise reduction and with the lowest possible computational complexity is provided for a hearing device and, in particular, for a hearing aid. Two-stage frequency transformation with little latency is therefore proposed for hearing aids. Some of the processing, for example the amplification, is carried out after high stopband attenuation in the first stage. An increased frequency resolution is achieved in a second stage before the back-transformation in the first stage, which is favorable for noise reduction, for example.

12 Claims, 3 Drawing Sheets

(56) References Cited

OTHER PUBLICATIONS

Mauler et al., "A Low Delay, Variable Resolution, Perfect Reconstruction Spectral Analysis-Synthesis for Speech Enhancement", Institute of Communication Acoustics (IKA), Ruhr-Universität Bochum, 44780 Bochum, Germany, Eusipco, Poznan 2007.
Vary, P, "An adaptive filter-bank equalizer for speech enhancement "Signal Processing 86, 2006, pp. 1206-1214.
Gerkmann et al. "Zweistufige Frequenztransformation mit geringer Latenz für Hörgerate" [Low-latency two-stage frequency transformation for hearing instruments] Dec. 7, 2009, pp. 1-2—English translation.
Ulrich et al., "Hörakustik" [Hearing Acoustics], First Edition, Heidelberg: DOZ Verlag, Oct. 2007—English translation of pp. 204-206 and pp. 719-727, ISBN 978-3-922269-80-9.
Löllmann et al., "A Warped Low Delay Filter for Speech Enhancement", Proceedings of International Workshop on Acoustic Echo Noise Control (IWAENC), Sep. 2006, Paris, pp. 1-4.
Fliege, Multiraten-Signalverarbeitungen : Theorie and Anwendungen, Stuttgart: Teubner-Verlag, 1993—English translation of pp. 251-255 and pp. 274-285, ISBN 3-519-06155-5.

* cited by examiner

HEARING DEVICE AND METHOD FOR OPERATING A HEARING DEVICE WITH TWO-STAGE TRANSFORMATION

CROSS-REFERENCE TO RELATED APPLICATION

This application claims the priority, under 35 U.S.C. §119, of German patent application DE 10 2010 026 884.4, filed Jul. 12, 2010; the prior application is herewith incorporated by reference in its entirety.

BACKGROUND OF THE INVENTION

1. Field of the Invention

The present invention relates to a method for operating a hearing device by segmenting and transforming an input signal of the hearing device in a first transformation stage to form a multichannel first-stage transformation signal, subjecting a first-stage signal to multichannel processing to form a multichannel first-stage processed signal and transforming back the multichannel first-stage processed signal in the first transformation stage and assembling the resultant multichannel signal to form an output signal. The present invention also relates to a corresponding hearing device. In this case, a hearing device is understood as meaning any sound-emitting device which can be worn in or on the ear, in particular a hearing aid, a headset, earphones or the like.

Hearing aids are portable hearing devices used to support the hard-of-hearing. In order to meet the numerous individual requirements, different types of hearing aids are provided, e.g. behind-the-ear (BTE) hearing aids, hearing aids with an external earpiece (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibro-tactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction earpiece. The amplifier is usually integrated in a signal processing unit (SPU). This basic design is illustrated in FIG. 1 using the example of a behind-the-ear hearing aid. One or more microphones 2 for recording the sound from the surroundings are installed in a hearing aid housing 1 to be worn behind the ear. A signal processing unit 3, likewise integrated in the hearing aid housing 1, processes the microphone signals and amplifies them. The output signal from the signal processing unit 3 is transmitted to a loudspeaker or earpiece 4 which emits an acoustic signal. If necessary, the sound is transmitted to the eardrum of the equipment wearer using a sound tube which is fixed in the auditory canal with an ear mold. A battery 5 likewise integrated in the hearing aid housing 1 supplies the hearing aid and, in particular, the signal processing unit 3 with energy.

Hearing aids perform, inter alia, two tasks. On the one hand, they ensure signal amplification in order to compensate for a loss of hearing and, on the other hand, noise must generally be reduced. Both tasks are tackled in the frequency domain, for which a spectral analysis/synthesis filter bank is required.

The design of the filter bank is subject to a multiplicity of underlying optimization criteria. The resultant filter bank is a compromise between time and frequency resolution, latency, computational complexity as well as cut-off frequency and stopband attenuation of the prototype low-pass filter.

A filter bank based on discrete Fourier transformation can be used for frequency analysis with a uniform resolution. A non-uniform resolution can be achieved by replacing the delay elements of the filter bank with all-pass filters, with a filter bank having a tree structure or with the use of wavelet transformation (T. Gülzow, A. Engelsberg and U. Heute, "Comparison of a discrete wavelet transformation and a non-uniform polyphase filterbank applied to spectral-subtraction speech enhancement", Elsevier Signal Processing, pages 5-19, Vol. 64, issue 1, January 1998).

Most of these methods have either one stage or, as in the case of filter banks having a tree structure, a plurality of stages but have a long algorithmic delay and a low frequency resolution without the four optimization possibilities mentioned. See, commonly assigned patent application publications US 2009/0290736 A1, US 2009/0290737 A1, and US2009/0290734 A1, and their counterpart European publications EP 2 124 334 A1, EP 2 124 335 A2, and EP 2 124 482 A2.

The signal delay can be reduced, on the one hand, by using short synthesis windows (D. Mauler and R. Martin, "A low delay, variable resolution, perfect reconstruction spectral analysis-synthesis system for speech enhancement", European Signal Processing Conference (EUSIPCO), pages 222-227, September 2007).

On the other hand, the resultant filter function can be transformed into the time domain and used there (P. Vary: "An adaptive filter-bank equalizer for speech enhancement", Elsevier Signal Processing, pages 1206-1214, Vol. 86, issue 6, June 2006). The signal delay is additionally reduced by shortening the time domain filter or by conversion into a minimum-phase filter (H. W. Löllmann and P. Vary, "Low delay filter-banks for speech and audio processing", in Eberhard Hänsler and Gerhard Schmidt: Speech and Audio Processing in Adverse Environments, Springer Berlin Heidelberg, 2008).

Filter banks are always a compromise between time and frequency resolution, signal delay and computational complexity. The compromise between time and frequency resolution is determined by the length and form of a prototype low-pass filter or prototype wavelet. Temporal extension of the prototype low-pass filter results in a lower time resolution and a higher frequency resolution. Furthermore, the temporal form of the prototype low-pass filter determines the compromise between the cut-off frequency and the stopband attenuation of a frequency response.

The compromise between time and frequency resolution or cut-off frequency and stopband attenuation, signal delay and computational complexity is made in advance and equally applies to all algorithms implemented in the hearing aid. This may be unfavorable since, for example, the amplification of individual bands in hearing aids requires high stopband attenuation in order to influence the remaining bands as little as possible by the amplification. In contrast, the stopband attenuation is less critical for noise reduction. Instead, a high frequency resolution is required in the lower frequency bands for high-quality noise reduction in order to enable noise reduction between the spectral harmonics of voiced sounds.

SUMMARY OF THE INVENTION

It is accordingly an object of the invention to provide a hearing device and a related method which overcome the above-mentioned disadvantages of the heretofore-known devices and methods of this general type and which provides for a method for operating a hearing device and a hearing device in which both better signal amplification and better noise reduction are possible.

With the foregoing and other objects in view there is provided, in accordance with the invention, a method of operating a hearing device, the method comprising the following steps, to be carried out in a variety of different sequential orders:

segmenting and transforming an input signal of the hearing device in a first transformation stage to form a multichannel first-stage transformation signal;

segmenting and transforming the multichannel first-stage transformation signal in a second transformation stage to form a multichannel second-stage transformation signal;

processing the multichannel second-stage transformation signal to form a processed multichannel signal;

forming a first-stage signal by either:

back-transforming the processed multichannel signal in the second transformation stage and assembling a resultant multichannel signal to form the first-stage signal; or determining a time domain filter function from the processed multichannel signal and filtering the multichannel first-stage transformation signal to form the first-stage signal;

subjecting the first-stage signal to multichannel processing to form a multichannel first-stage processed signal; and transforming back the multichannel first-stage processed signal in the first transformation stage and assembling a resultant multichannel signal to form an output signal.

In other words, the objects of the invention are achieved by a method for operating a hearing device by segmenting and transforming an input signal of the hearing device in a first transformation stage to form a multichannel first-stage transformation signal, subjecting a first-stage signal to multichannel processing to form a multichannel first-stage processed signal, and transforming back the multichannel first-stage processed signal in the first transformation stage and assembling the resultant multichannel signal to form an output signal, segmenting and transforming the multichannel first-stage transformation signal in a second transformation stage to form a multichannel second-stage transformation signal, processing the multichannel second-stage transformation signal, and transforming back the processed multichannel signal in the second transformation stage and assembling the resultant multichannel signal to form the first-stage signal or determining a time domain filter function from the processed multichannel signal and filtering the multichannel first-stage transformation signal to form the first-stage signal.

With the above and other objects in view there is also provided, in accordance with the invention, a hearing device having a first transformation device for segmenting and transforming an input signal of the hearing device in a first transformation stage to form a multichannel first-stage transformation signal, a first processing device for subjecting a first-stage signal to multichannel processing to form a multichannel first-stage processed signal, and a first back-transformation device for transforming back the multichannel first-stage processed signal in the first transformation stage and assembling the resultant multichannel signal to form an output signal, and comprising a second transformation device for segmenting and transforming the multichannel first-stage transformation signal in a second transformation stage to form a multichannel second-stage transformation signal, a second processing device for processing the multichannel second-stage transformation signal, and a second back-transformation device for transforming back the processed multichannel signal in the second transformation stage and assembling the resultant multichannel signal to form the first-stage signal or a filter device for determining a time domain filter function from the processed multichannel signal and filtering the multichannel first-stage transformation signal to form the first-stage signal.

It is thus advantageously possible to carry out processing at two resolution levels. In particular, two-stage spectral analysis is enabled. Whereas, for example, the first stage may be distinguished by high attenuation in the stopband of the filter, the second stage may increase the frequency resolution of the first stage. The output from the first stage is thus suitable for high frequency-dependent amplification, while the output from the second stage is suitable for noise reduction with a high frequency resolution. The algorithmic total delay of the input signal may be selected to be very short. In one variant, the multichannel processing in the first stage is carried out before the processing steps in the second stage. In another embodiment, the multichannel processing in the first stage is carried out after the processing steps in the second stage. One variant or another can be selected depending on how the individual processing stages influence one another.

The multichannel processing in the first stage preferably comprises amplification and/or compression. This is advantageous, in particular, when this first stage has high stopband attenuation.

In another preferred embodiment, only some of the channels of the multichannel transformation signal are segmented, transformed, processed and transformed back or filtered in the second stage. Despite an increased frequency resolution caused by the second stage, a reduced degree of computational complexity can thus be achieved overall since not all channels are processed in the second stage. In this case, the remaining channels of the multichannel transformation signal which are not processed in the second stage should be delayed in accordance with the second stage.

Weighting factors can be determined in the second stage and can be used for weighting when processing the multichannel second-stage transformation signal. Current weighting can therefore always be carried out by continuously tracking the weighting factors.

Filtering can also be carried out in the second stage after segmentation and/or before assembly, during which filtering the low-frequency channels are emphasized. This may go so far as to completely suppress the upper channels after back-transformation, thus making it possible to reduce the computational complexity.

In an alternative embodiment, the number of channels can be reduced in the second stage after the time domain filter function has been determined. This makes it possible to reduce the signal delay.

Alternatively, the time domain filter function can be converted into a minimum-phase filter function in the second stage. This also makes it possible to reduce the signal delay.

Other features which are considered as characteristic for the invention are set forth in the appended claims.

Although the invention is illustrated and described herein as embodied in a method for operating a hearing device with two-stage transformation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below are preferred embodiments of the present invention.

Two-stage spectral analysis is provided according to the main concept of the present invention. While, for example, the first stage is distinguished by high attenuation in the stopband of the filters, the second stage is intended to increase the frequency resolution of the first stage. The output from the first stage is thus suitable for high frequency-dependent amplification, while the output from the second stage is suitable for noise reduction with a high frequency resolution. In this case, the algorithmic total delay of the input signal is intended to be very short.

Figure 1:
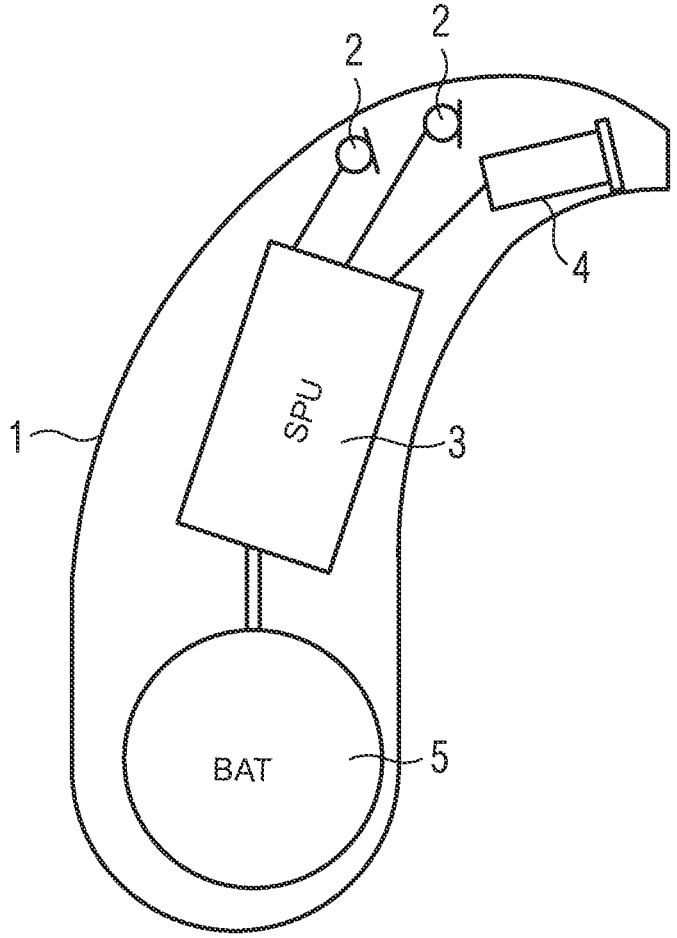
FIG. 1 PRIOR ART
FIG. 1 shows the basic design of a hearing aid according to the prior art.
Figure 2:
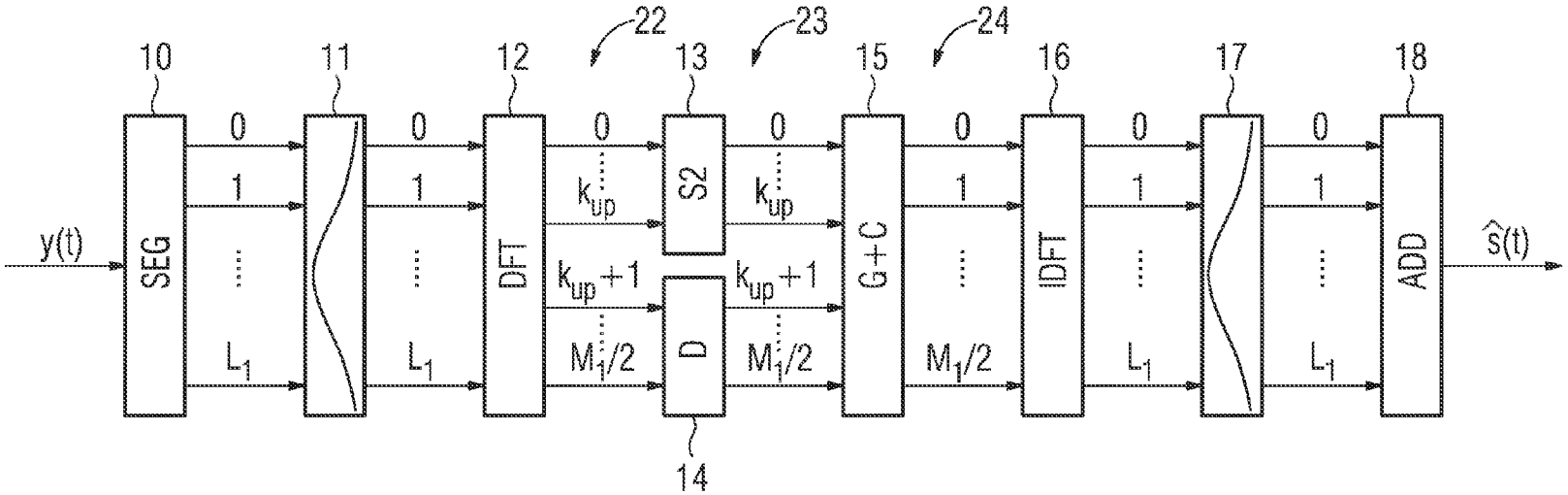
FIG. 2 shows a block diagram of a signal processing method according to the invention with two-stage frequency transformation.

In accordance with the example in FIG. 2, the exemplary signal to be processed is a time domain signal y(t) which is present in a hearing device and, in particular, is an input signal of a hearing aid that originates from a microphone. The input signal y(t) is supplied to a segmenting unit 10 which breaks down the input signal into a plurality of channels (0 to $L_1$). A prototype filter 11 is then used for multiplication by the prototype filter function (a bell curve in this case) in the time domain. This results in a reduction in aliasing effects. After the time domain filtering, a transformation unit 12 carries out transformation (discrete Fourier transformation in this case). Whereas the prototype low-pass filter 11 has the length $L_1$ in this first stage, the transformation unit 12 has the length $M_1$. Since the input signal has a real value, the DFT provides $M_1/2$ non-redundant coefficients. The coefficients 0 . . . $k_{up}$ are spectrally more highly resolved in a second stage 13, where $k_{up}<M_1/2$. The remaining coefficients $k_{up}+1$ to $M_1/2$ are supplied to a delay unit 14. There, the signals are delayed just like those which pass through the processing in the second stage 13. After the second stage 13 and the delay unit 14, there are just as many frequency channels as there are after the DFT 12. The signals in the frequency bands from the second stage 13 and from the delay unit 14 are supplied to a processing unit 15 which carries out amplification and compression in a band-by-band manner here. The number of frequency bands remains unchanged overall ($M_1/2$). The output signal from the processing unit 15 is supplied to a back-transformation unit 16 which is used to generate $L_1$ signal segments in the time domain. A subsequent prototype low-pass filter 17 ensures that aliasing effects are reduced. An assembling device 18 finally assembles all temporal segments from the filter 17 by overlapping and adding, thus resulting in an output signal ŝ(t).

In the present application, the output signal 22 from the transformation unit 12 is also called a multichannel first-stage transformation signal. The multichannel output signal 23 from the second stage 13 is also referred to as a multichannel first-stage signal. Furthermore, the signal 24 after the processing unit 15 is referred to as a multichannel first-stage processed signal. The output signal from the entire back-transformation device, including the back-transformation unit 16, the filter 17 and the assembling unit 18, corresponds to the signal ŝ(t).

The frequency resolution of the first analysis stage can be increased in the second analysis stage 13. The signal 22 following the transformation in the first stage is intended to be suitable, in particular, for high frequency-dependent amplification. Prototype low-pass filters 11 with high stopband attenuation are required for this purpose, and so the frequency resolution is limited with a fixed signal propagation time. The increase in the frequency resolution caused by the second stage 13 is especially advantageous for noise reduction since the interfering noise can then also be reduced between the spectral harmonics of voiced speech sounds. High stopband attenuation is not as decisive for the second stage as it is for the first stage. However, it is important that the total delay of the first and second stages remains low and does not exceed 10 ms, for example.

Figure 3:
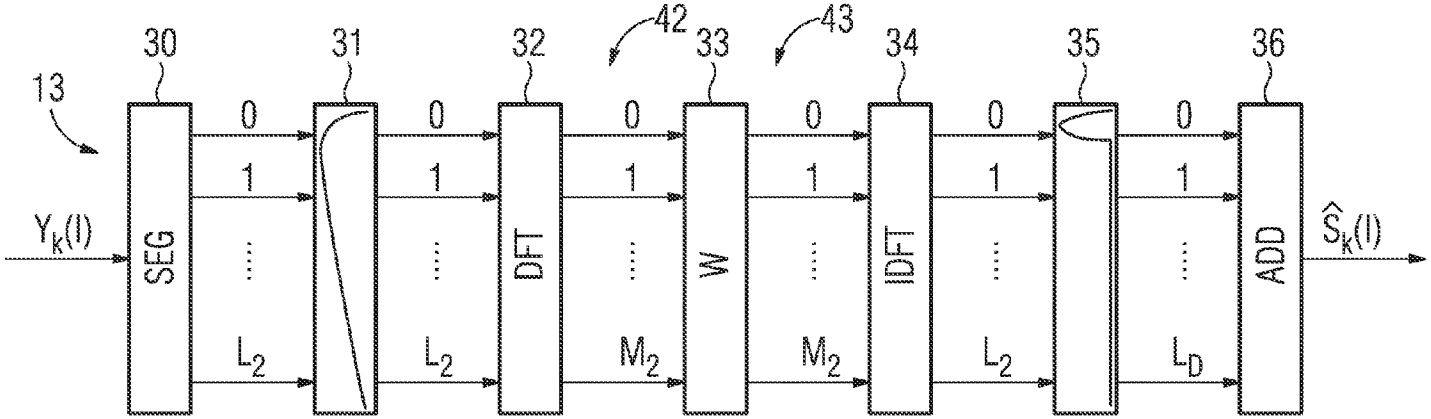
FIG. 3 shows a block diagram of the processing steps in the second stage according to a first embodiment.

FIG. 3 schematically illustrates a block diagram of an exemplary embodiment of the second stage 13. In this case, the input signal is symbolically one of the complex frequency band signals $Y_k(l)$, where l is a time variable. Frequency transformation is likewise carried out in the second stage 13. The frequency band signals are broken down further. For this purpose, the frequency band signal $y_k(l)$ is supplied to a segmenting unit 30 which subdivides the signal into $L_2$ subbands. The resultant signal is filtered by a downstream prototype low-pass filter 31 in the analysis part of the second stage. The prototype low-pass filter 31 has the length $L_2$. Discrete Fourier transformation of the length $M_2$ is then carried out in a transformation unit 32. A weighting function or weighting factors is/are calculated from the output signals from the transformation unit 32 in a processing unit 33 and is/are used. The back-transformation unit 34 carries out back-transformation in the synthesis part. The subsequent prototype low-pass filter 35 of the synthesis part has $L_D$ values which are different from zero, where $L_2 \geq M_2 >> L_D$ usually applies. After the prototype low-pass filter 35, the signal components are added in an overlapping manner in an assembling unit 36, which results in an output signal ŝ(l). The second stage 13 is applied to each of the bands 0, . . . , $k_{up}$ in FIG. 2. In this case, k and l are the frequency and segment indices of the first stage.

This second stage is based on the method of Mauler and Martin, mentioned in the introductory text. It enables a high frequency resolution with a selectable algorithmic delay. In the method, short synthesis windows are used to keep the signal delay short. The signal delay of the second stage is given by the length of the synthesis window −1.

The two-stage method also enables an unequal frequency resolution by applying the second stage to the bands 0, . . . , $k_{up}$. The remaining bands $k_{up}+1$, . . . , $M_1/2$ are delayed by the delay of the second stage. The high frequency resolution at the low frequencies allows the resolution of spectral harmonics of voiced sounds, whereas the high temporal resolution in the upper frequency bands enables good temporal reproduction of short speech sounds such as plosives. Furthermore, application of the second stage to only some of the frequency bands in the first stage is favorable in terms of the computational complexity. The bands in the first stage usually overlap to a relatively great extent. In the second stage, the spectral weighting function (for example for amplification) can be calculated only for the part which does not overlap, which results in a further reduction in the computational complexity.

The input signal $y_k(l)$ corresponds to a band in the multichannel first-stage transformation signal 22. The signal after the transformation unit 32 is also referred to as a multichannel second-stage transformation signal 42 in this case. The signal after the processing unit 33 is called a processed multichannel signal 43. The output signal $\hat{s}_k(l)$ corresponds to a segment of the signal 23 in the first stage l.

Figure 4:
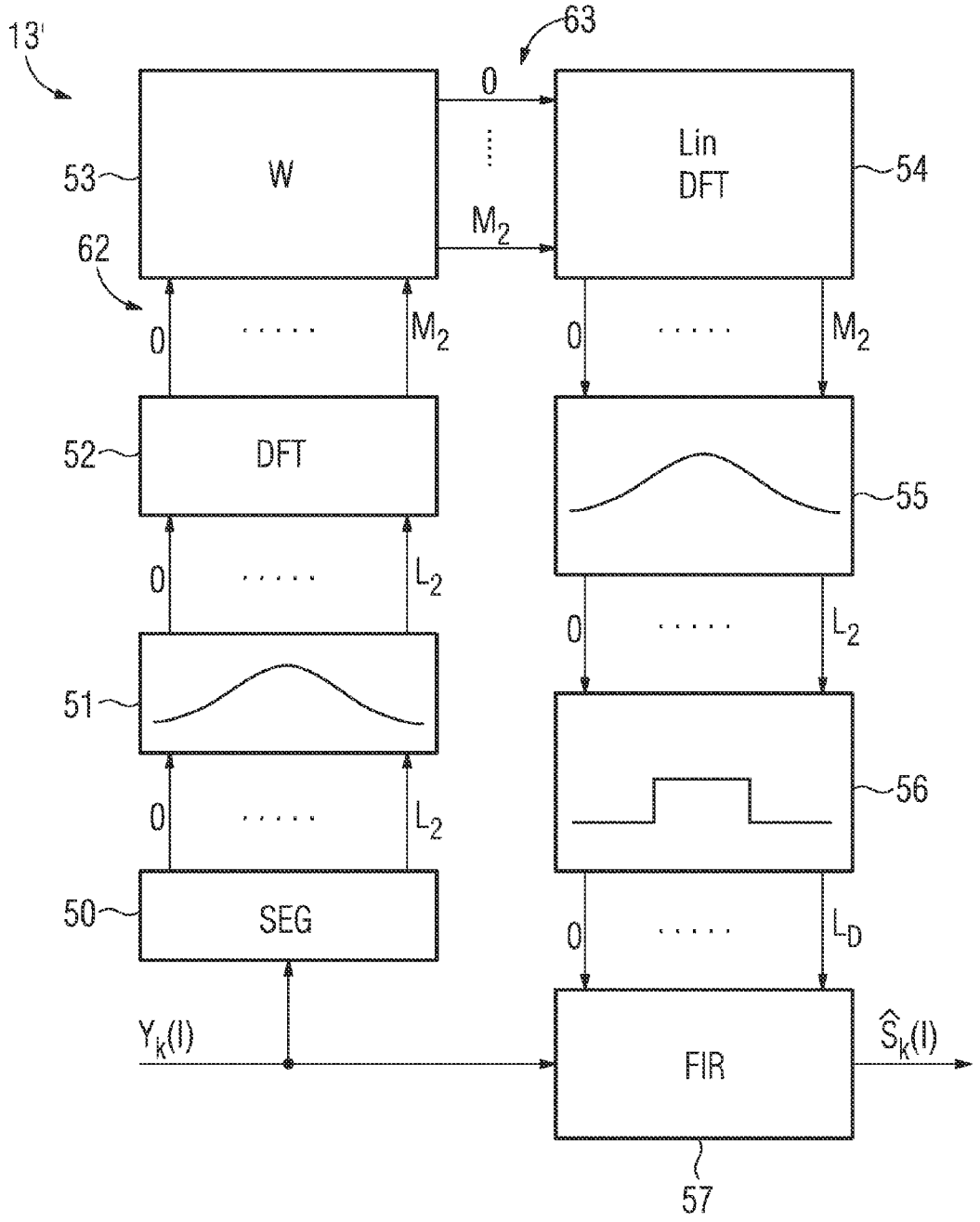
FIG. 4 shows a block diagram of the processing steps in the second stage according to an alternative embodiment.

In an alternative embodiment, the method according to Löllmann and Vary, which was likewise mentioned in the introductory text, is used for the second stage. In this case, filtering is carried out in the time domain. Instead of the second stage 13 of the exemplary embodiment in FIG. 3, an alternative second stage 13' according to the block diagram in FIG. 4 is thus carried out. The input signal is again the frequency band signal $Y_k(l)$. After a segmenting unit 50 and a prototype low-pass filter 51, segment-by-segment transformation in the Fourier domain is also carried out here in a transformation unit 52. A spectral weighting function W is calculated there in a processing device which has a computation unit 53, which weighting function is then converted into a linear-phase time domain filter function in a further computation unit 54. The length of the units 52, 53 and 54 is $M_2$ in each case, while the length before the transformation is $L_2$. Following the linear-phase transformation, filtering is carried out by a further prototype low-pass filter 55 in the synthesis part of the second stage 13'. The prototype low-pass filter 55 has the length $L_2$. The resultant signal is then shortened to the length $L_D$ by a shortening unit 56. As an alternative to shortening, the linear-phase time domain filter can be converted into a minimum-phase filter. $L_2 \geq M_2 >> L_D$ usually also applies in this case. The second stage is applied to each of the bands 0, . . . , $k_{up}$ in FIG. 2. In this case too, k and I are again the frequency and segment indices of the first stage.

Following the transformation in the second stage, the signal is also referred to as a multichannel second-stage transformation signal 62 in this case. The signal after the weighting unit 53 is referred to as a processed multichannel signal 63 in this case. The output signal $\hat{s}_k(l)$ corresponds to the first-stage signal 23 in FIG. 2.

A filter unit 57 in this case carries out FIR filtering of the multichannel first-stage transformation signal 22 (symbolized here by the individual band $Y_k(l)$). The $L_D$ filter coefficients come from the shortening unit 56. The filtered signal, symbolized by the segment $\hat{s}_k(l)$, corresponds to the multichannel first-stage processed signal 23.

In the method according to the exemplary embodiment in FIG. 4, a filter function is thus used in the time domain. In order to achieve a signal delay which is as short as possible, the time domain filter can be shortened or converted into a minimum-phase filter.

In this method, the signal delay of the second stage is given by the group delay of a linear-phase Finite Impulse Response (FIR) filter or a minimum-phase autoregressive (AR) filter. The group delay of a linear-phase FIR filter is dependent on the filter length $L_D$ and is given by $(L_D-1)/2$. In the extreme case, if the synthesis window according to the exemplary embodiment in FIG. 3 or the FIR filter according to the exemplary embodiment in FIG. 4 only has a length of one sample, the second stage does not cause any algorithmic delay at all.

The present invention thus makes it possible to apply algorithms to the outputs from that stage which is better suited to the respective algorithm. The two-stage method is also favorable in terms of the computational complexity since the frequency analysis in the first stage is used as preprocessing for the second stage.

Furthermore, the two-stage method enables different frequency resolutions in the bands. The second stage is preferably applied only to the lower frequency bands, with the result that the lower frequency bands have a high frequency resolution, while the upper frequency bands have a high temporal resolution.

As mentioned, the high frequency resolution at the low frequencies allows the resolution of spectral harmonics of voiced sounds, while the high temporal resolution in the upper frequency bands allows good temporal reproduction of short speech sounds such as plosives. Furthermore, application of the second stage to only some of the frequency bands in the first stage is favorable in terms of the computational complexity.

The bands in the first stage usually overlap to a relatively great extent. In the second stage, the calculation of the spectral weighting function can be reduced, according to the invention, to high-resolution subbands in the second stage which do not overlap, which results in a further reduction in the computational complexity.

In contrast to a filter bank having a tree structure, the filter bank according to the invention has a very short signal delay. The signal delay can be freely selected by the window function or by shortening the second stage.

The invention claimed is:

1. A method of operating a hearing device, the method which comprises:

segmenting and transforming an input signal of the hearing device in a first transformation stage to form a multichannel first-stage transformation signal;

segmenting and transforming the multichannel first-stage transformation signal in a second transformation stage to form a multichannel second-stage transformation signal;

processing the multichannel second-stage transformation signal to form a processed multichannel signal;

forming a first-stage signal by either:

a) back-transforming the processed multichannel signal in the second transformation stage and assembling a resultant multichannel signal to form the first-stage signal; or b) determining a time domain filter function from the processed multichannel signal and filtering the multichannel first-stage transformation signal to form the first-stage signal;

subjecting the first-stage signal to multichannel processing to form a multichannel first-stage processed signal; and transforming back the multichannel first-stage processed signal in the first transformation stage and assembling a resultant multichannel signal to form an output signal.

2. The method according to claim 1, which comprises carrying out the multichannel processing in the first stage before the processing steps in the second stage.

3. The method according to claim 1, which comprises carrying out the multichannel processing in the first stage after the processing steps in the second stage.

4. The method according to claim 1, which comprises carrying out the multichannel processing in the first stage before and after the processing steps in the second stage.

5. The method according to claim 1, wherein the multichannel processing in the first stage comprises amplification and/or compression.

6. The method according to claim 1, which comprises segmenting, transforming, processing and transforming back or filtering only some of the channels of the multichannel transformation signal in the second transformation stage.

7. The method according to claim 6, which comprises delaying remaining channels of the multichannel transformation signal that are not being processed in the second transformation stage in accordance with the second stage.

8. The method according to claim 1, which comprises determining weighting factors in the second stage and weighting with the weighting factors when processing the multichannel second-stage transformation signal.

9. The method according to claim 1, which comprises filtering in the second stage after segmentation and/or before assembly, and thereby emphasizing lower-frequency channels during the filtering.

10. The method according to claim 1, which comprises reducing a number of channels in the second stage after the time domain filter function has been determined.

11. The method according to claim 1, which comprises converting a time domain filter function into a minimum-phase filter function in the second stage.

12. A hearing device, comprising:

an input configured to receive an input signal of the hearing device;

a first transformation device connected to receive the input signal) and configured for segmenting and transforming the input signal in a first transformation stage to form a multichannel first-stage transformation signal; and a second transformation device connected to receive the multichannel first-stage transformation signal and configured for segmenting and transforming the multichannel first-stage transformation signal in a second transformation stage to form a multichannel second-stage transformation signal; and a second processing device connected to receive the multichannel second-stage transformation signal and configured for processing the multichannel second-stage transformation signal; and a) a second back-transformation device for transforming back the processed multichannel signal in the second transformation stage and assembling a resultant multichannel signal to form a first-stage signal; or b) a filter device for determining a time domain filter function from the processed multichannel signal and filtering the multichannel first-stage transformation signal to form the first-stage signal; and a first processing device for subjecting the first-stage signal to multichannel processing to form a multichannel first-stage processed signal; and a first back-transformation device connected to receive the multichannel first-stage processed signal and configured for transforming back the multichannel first-stage processed signal in said first transformation stage and assembling a resultant multichannel signal to form an output signal.

* * * * *